United States Patent [19]

Stack et al.

[11] Patent Number: 5,021,761

[45] Date of Patent: Jun. 4, 1991

[54] HIGH-AMP CIRCUIT BREAKER AND A BISTABLE ELEMENT THEREFOR

[75] Inventors: Thomas J. Stack, Chicago; Jacek M. Korczynski, Niles, both of Ill.

[73] Assignee: Cooper Industries, Inc., Houston, Tex.

[21] Appl. No.: 414,095

[22] Filed: Sep. 28, 1989

[51] Int. Cl.[5] ..... H01H 71/16

[52] U.S. Cl. ..... 337/68; 337/91; 337/365

[58] Field of Search ..... 337/68, 91, 111, 379, 337/365, 89

[56] References Cited

U.S. PATENT DOCUMENTS

| | | | |
|---|---|---|---|
| 2,720,416 | 10/1955 | Raleigh | 337/89 |
| 4,803,455 | 2/1989 | Kuczynski | 337/68 |
| 4,814,739 | 3/1989 | Moldovan | 337/68 |

*Primary Examiner*—H. Broome

*Attorney, Agent, or Firm*—Laff, Whitesel, Conte & Saret

[57] ABSTRACT

A low voltage high-amp circuit breaker having a substantially rectangular bimetallic bistable element and a pair of terminals extending from the side thereof. The bistable element is attached to have one end move from a first normal electrically conductive position to a second non-electrically conductive position. The manual reset circuit breaker includes a manual reset lever and a non-conductive heat resistant extension blade connected to the reset lever via a rotatable shaft. The extension blade being positioned adjacent the moveable end of the bistable element and when the element is moved to its second position, the blade is moved to prevent the element from returning to its first conductive position until the circuit breaker is manually reset.

6 Claims, 3 Drawing Sheets

HIGH-AMP CIRCUIT BREAKER AND A BISTABLE ELEMENT THEREFOR

The present invention relates to a High-Amp Circuit breaker assembly and also to the bimetallic bistable element that is used in the assembly.

More particularly the assembly of the present invention has a manual reset or an auto reset mechanism which utilizes a substantially rectangular bimetallic bistable thermally active element to provide for overload protection.

BACKGROUND

Circuit breakers which are panel mount or firewall mount usually have their terminals on different sides of the circuit breaker assembly. This makes it difficult to field wire the circuit breaker into the circuit to be protected.

Also the manual reset circuit breakers are generally constructed so that it is not readily seen that the circuit breaker has opened to protect the circuit from an overload or a surge in current.

Both the manual and the auto reset high amp circuit breaker assemblies which are generally available are relatively difficult to manufacture. The bimetallic bistable elements used to open and close the breaker circuit usually require a relatively complex structure to operate with the quickness that is necessary to protect a circuit from damage. The structure used is a cylindrical bimetallic disc that has a small clearance hole at the center. The disc is then stamped into a dome shaped element via a radial stamping die to a predetermined amount thus providing the necessary bistable condition. A finely threaded screw is placed through the center hole and engaged into a mating female thread within the units main housing. The screw is tightened to preload the central dome or hump. The disc has a pair of contacts on opposite sides of the diameter. In the assembly the disc contacts have corresponding contacts attached to termination lugs. When the disc circuit breaker encounters an over-current, the disc goes from concave to convex to open the circuit and returns in the automatic reset style when the over-current is not present and a predetermined time has past to allow the element to sufficiently cool. The manual reset style operates similarly except that the bistable element is over-stressed so that when an over-current causes the convex condition, the element must be returned to the concave form by physical force via a push-button resetting mechanism.

These types of circuit breakers for low voltage DC applications with high amperage ratings utilize generally large and broad forming radii that as a process exhibits high variability. This results in circuit breakers which are relatively costly to manufacture because the manufacturing process is labor intensive. Each unit has to be individually calibrated at the factory. The center adjusting screw for each unit must be manually tightened to bring the contacts into a pre-load condition. Then each unit must be tested to be sure it is properly calibrated to open and close as required to protect a circuit.

SUMMARY OF THE INVENTION

An object of the present invention to provide a bimetallic bistable thermally active element that can be easily manufactured without the necessity of fine-tuning the calibration of each unit.

It is still another object of the present invention to provide a bistable thermally active element for high amp low-voltage DC circuit breakers.

It is still another object of the present invention to provide new and improved high-amp manual and auto reset circuit breakers for firewall and panel mounting.

In accordance with one embodiment of the invention, a bistable thermally active element is rectangular with a width greater than ½ of its length. One end of the element is to be fixed and the other end has a contact attached thereto. The other end with contact attached is the moveable end and snaps from a first normal position to a second position. Through the snap action of each element and inherent resistibility calibration for a particular over-load amperage is achieved. The element has at least one dimple formed thereon to provide the desired snap action.

In another embodiment of the invention, a low voltage high amp circuit breaker includes a housing and one pair of terminals fixed to the housing and extending from the same outer side of the housing. Within a cavity formed in the housing are first, second and third contacts electrically connected respectively to said bistable element and said pair of terminals. The first fixed contact is fixedly attached to one end of a rectangular thermally responsive bimetallic bistable element.

Attached to the other end of the bistable element is a contact. The second contact is positioned relative to the fixed third contact so that they are normally in electrical contact. The element is so calibrated that when an overload is encountered the element's active end snaps to a second position which separates the second contact from a third fixed contact attached to a terminal in close proximity to the second contact to open the circuit of the circuit breaker. After a predetermined time, the element is calibrated to snap back into its first position. The element has at least one dimple formed thereon.

In still another embodiment of the invention there is a low voltage high-amp circuit breaker which is autosetting and is either a firewall or panel mount. The circuit breaker has a generally central closed cavity with the rectangular bistable thermally responsive element, as described above mounted therein and connected to a pair of terminal means extending externally from the same side of the circuit breaker to allow for, easy electrical connectors to the circuit breaker.

In still another embodiment of the invention there is a manual-reset high-amp circuit breaker having a generally central closed cavity. The rectangular bistable thermally responsive element, as described above is mounted in said cavity. The one end of the bistable element is fixed to a contact for a first terminal and is generally not moveable. The other end of the bistable element has a second contact thereon that is normally in electrical contact with a third contact that is for the second terminals. A rotatable shaft is mounted in the cavity and extends outside of the housing.

A manual reset lever is attached to the rotatable shaft and pivots when the shaft rotates. An extension blade is attached to the shaft and positioned adjacent the element contact. A spring means attached to said shaft. The extension blade and spring are positioned so as not to interfere with the normal on position of the circuit breaker-electrical contact between the second and third contacts when there is no overload. However, when there is an overload and the second contact snaps away from the third contact, and the spring turns the shaft to position the extension blade between the second and third contacts. The reset lever is rotated and visually shows that the circuit breaker is in its open condition. When the overload condition is terminated and a predetermined time has passed, the second contact is prevented from contacting the third contact by the extension blade. The circuit breaker remains open until it is manually reset. The circuit breaker remains tripped and nonconducting until it is manually reset. The reset lever is attached to the shaft so that when the reset lever is manually pivoted to its reset position, the extension blade is moved from between the second and third contacts to a ready non-insulating position. The second and third contacts are in their on or electrical contact position. The reset lever and both terminals are all on the same external side of the housing to provide for easy visual means to determine the condition of the circuit breaker and to provide an easy electrical access to the circuit breaker.

DESCRIPTION OF PREFERRED EMBODIMENTS

The drawings show various views of the circuit breakers of the present invention.

Figure 1:
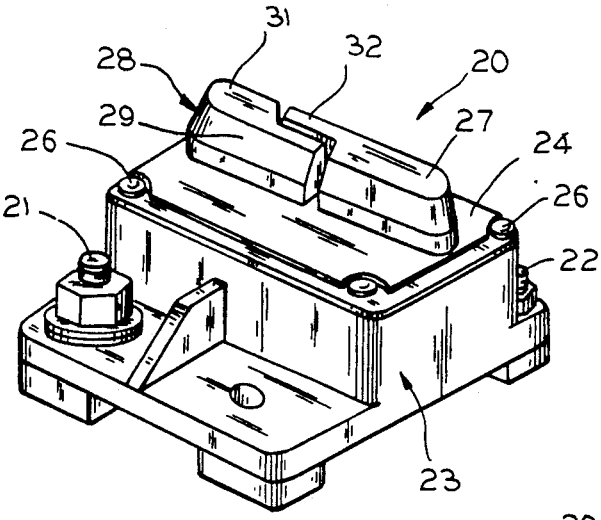
FIG. 1 is a top front right perspective view of a fire wall circuit breaker of the present invention having a manual reset.
Figure 2:
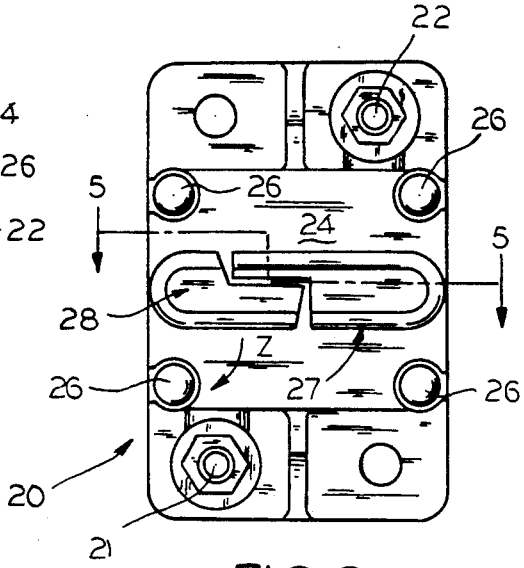
FIG. 2 is a top plan view of FIG. 1.

Referring to FIG. 1 and 2, we show a firewall mount high-amp manual reset circuit breaker 20. The circuit breaker has two external terminals 21, 22 extending from the same external side of the breaker. The terminals are preferably mounted on opposite sides of a central housing 23. Thus, the terminals may be reached easily from one side of the circuit breaker. On top of the central housing cover 23 is a blank preferably hollow raised housing 27 and a pivoting reset lever 28. The reset lever has a handle 29 which pivots about its end 31 as is described in more detail hereinafter. This blank housing 27 is utilized to give an aesthetic appearance to the circuit breaker and is shaped to complement the features of the reset lever. Also, the stationary portion 32 prevents the reset lever handle 29 from being accidentally turned in the direction of the stationary portion 32. If there was no stop means 32, the accidental turning of the reset handle 29 during shipping or use would most likely damage the circuit breaker and require replacement. The manual reset lever is in a side by side fit with the blank housing and is rotated or pivoted in the direction Z shown when there is an overload current of a predetermined magnitude. When the reset lever is pivoted to its trip position (not shown), the circuit of the circuit breaker is opened to prevent electricity from passing therethrough.

Figure 5:
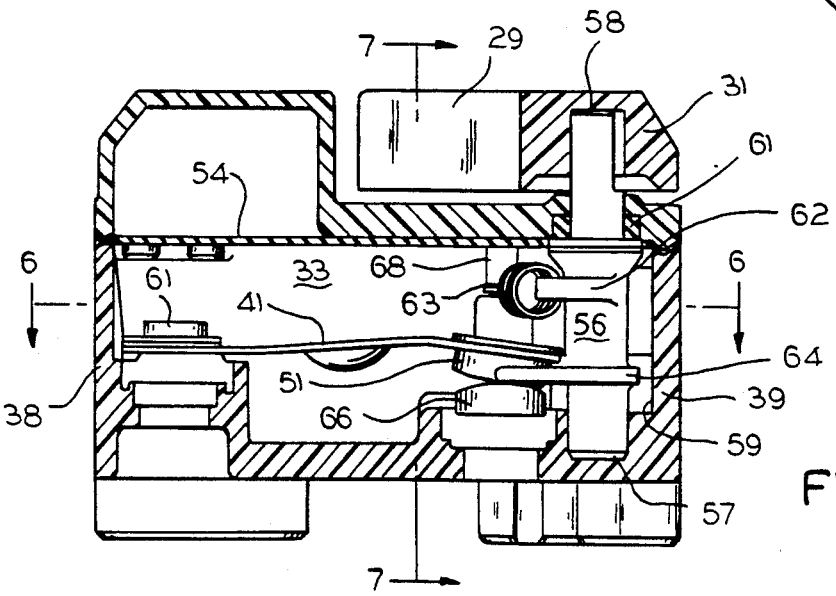
FIG. 5 is a partial section view taken along lines 5—5 of FIG. 2.

After the overload condition ceases and a predetermined time has passed the reset lever handle 29 can be returned manually to the position shown in FIGS. 1 and 2 and return the circuit breaker to its on or closed circuit position. A bimetallic bistable, thermally activated element 41 is mounted in the cavity 33. The bistable mechanical element is manufactured to have a predetermined overcurrent snap action. The bistable element 41 in a non-overload condition is in a first relatively horizontal position as shown in FIG. 5. When there is an overload, the bistable element heats up and deflects to snap into a second position (not shown).

Figure 9:
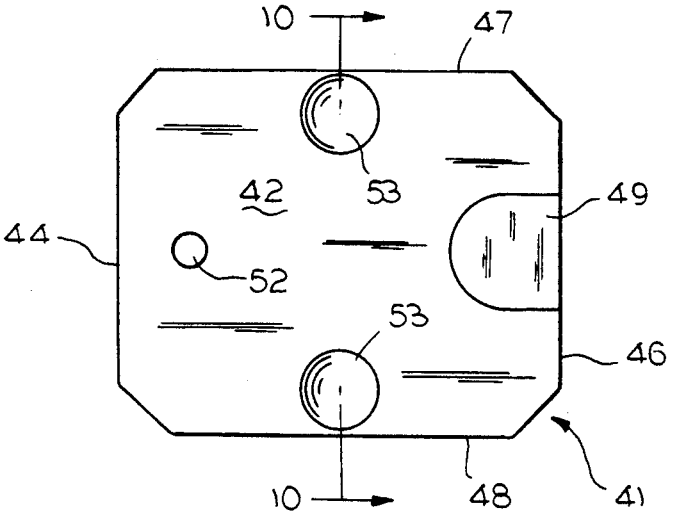
FIG. 9 is a top view of the bimetallic bistable element of the present invention.
Figure 10:
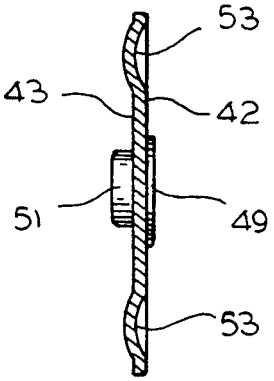
FIG. 10 is a sectional view taken along lines 10—10 of FIG. 9.
Figure 11:
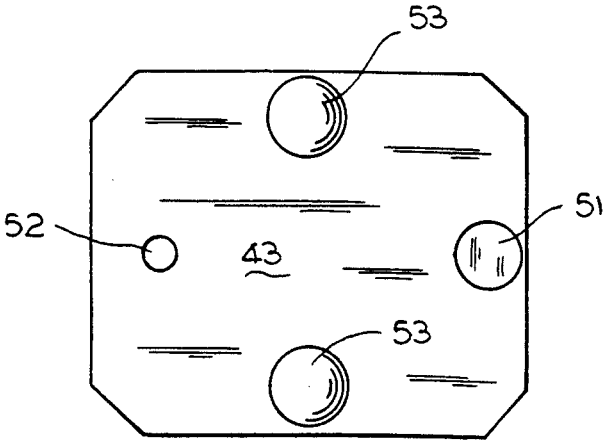
FIG. 11 is a bottom plan view of FIG. 9.

The bimetallic bistable element 41 is best shown in FIGS. 9–11. The bistable element is a known thermally reactive composite alloy. The bistable element has a top surface 42, bottom surface 43, a fixed end 44, a moveable end 46 and two sides 47, 48. A weld disc 49 and a preferably silver contact 51 are welded to the moveable end 46 of the element. The weld disc is attached to the top surface 42 and the silver contact 51 to the bottom surface 43. Both the contact 51 and the weld disc 49 extend inwardly from the top edge of the end 46 and are preferably in the center of the end 46.

On the other end 44 there is an appropriate hole 52. Adjacent each side 47 & 48 is a dimple 53. Each dimple has a diameter of 5/16 to $\frac{3}{8}$ inches and a depth of 0.050 to 0.080 inches. The dimples are concave on the top surface 42 convex on the bottom surface 43.

The length of the element is 1 5/16 to $1\frac{1}{2}$ inches and the width is 1 to $1\frac{1}{4}$ inches. Thus, the width is greater than $\frac{1}{2}$ the length. The dimples along with the material used in the bistable element are predetermined such that the bistable element will provide an instantaneous snap action when it senses the predetermined overload. The bistable element includes a length and a width that is at least 75% of the length and width of body cavity 33.

The bistable elements of the present invention can be accurately calibrated in mass. Bistable elements for a particular overload will generally all have the same size having the same number and size of dimples and made from the same material. Thus, only a representative sampling of the bistable elements and their respective high-amp circuit breakers are necessary. The advantages of mass producing the circuit breakers without the necessity of having individual calibration is one of the advantageous economical features of the present invention. The high-amp low voltage circuit breakers which were generally used prior to our invention, use a disc construction which requires almost individual calibration.

Referring to FIG. 5, the manual reset circuit breaker has an insulating plastic central housing 23 and an insulating plastic cover 24. The cover is sealed to the housing. Although rivets 26 are used to fix the cover to the housing, any appropriate fastening means can be used. Between the cover and the housing is an appropriate seal 54 which extends over the entire body cavity.

Within the body cavity 33 and adjacent end wall 39, there is located a rotatable non-conductive insulating elastic shaft 56. The shaft 56 has two ends 57, 58. The one end 58 is inserted in a blind hole 59 formed in the base of the cavity and its other end 57 extending outside of the cavity and through the cover 23 for a predetermined distance. Another seal 61 aids in the sealing of the shaft 56 from the exterior of the housing cover.

The manual reset lever is pressure fitted onto the rod end 58 to provide the arrangement shown in FIG. Therefore, when the circuit breaker is open, the reset lever is rotated or pivoted and in the direction Z for a predetermined distance. The rotated reset handle is a visual indication that the breaker must be reset. The resetting must be done manually.

The shaft or rod 56 has a first spring attaching bar 62 integrally extending therefrom. This bar 62 is used to connect one end of an extension spring 63. Spaced a predetermined distance below the first bar is a non-conductive heat resistant second extension bar or extension blade 64. The second extension blade 64 extends a predetermined distance substantially radially from the shaft 56. The extension blade is spaced a predetermined distance above the base of the housing. Preferably, the extension blade has a rudder-like or similar form with a first straight edge, a predetermined width and a rounded portion. The size and length of the second extension blade 64 is determined so that it can fit between the element contact 51 and a terminal contact 66 to maintain an electrical insulation therebetween and to keep the two contacts separated if desired. This will be described in greater detail hereinafter.

The bistable element 41 is mechanically staked at its one end 44 to the first terminal contact 67. The bistable element is sized and the rotatable shaft 56 is mounted in the cavity such that the other end 46 is adjacent to the rotatable shaft. The mounting height of the bistable element in the cavity is such that the contact 51 is generally in the same plane as the second extension blade 64. The flat side surface of the second extension blade 64 rests against the end surface of the circular element contact 51 when the breaker circuit is in its closed position.

The second extension blade 64 is urged towards the contact 51 by the extension spring 63 which has its other end connected to the cover attachment and spring holder 68. This cover attachment and spring holder 68 is located on one side of the inside of the housing.

The second terminal has located within the housing the stationary contact 66 which is situated just below the element contact 51, adjacent to the rotatable shaft 56 and below the second extension blade 64. The extension blade is such that it extends at least to the center of the element contact 51 and the terminal contact 56 when the circuit breaker is in its open position.

In operation, the high-amp circuit breaker is in its normal closed position as shown in FIG. 5. The spring 63 is in its extended position urging the extension blade 64 towards and against the element contact 51. The terminal contact 66 and the element contact 51 are in electrical contact with each other. When there is a predetermined overload in a circuit connected via terminals 21 and 22, the bistable element 41 snaps its end 46 to the second position wherein the element contact is raised a predetermined distance above the terminal contact and the blade 64 is then moved between the two contacts. The blade 64 in this position electrically insulates the two contacts from each other and prevents contact 51 from recontacting 66 until the breaker is reset. When referring to FIG. 1, when there is an overload, the reset lever is now moved in a direction such that the handle is moved away from the blank housing. In a preferred embodiment there will be a yellow or iridescent label that will indicate the circuit breaker needs resetting. However, even without the indication, it is readily observable that the breaker needs to be reset.

The resetting is a quick and easy operation. The lever is merely turned towards the blank housing and the shaft is rotated such that the extension blade 64 is moved from between the element contact 51 and the second terminal contact 66. The spring 63 is extended. As soon as the extension blade 64 is removed from between the two contacts 51 and 56, the element contact 51 returns to the position shown in FIG. 5 and the extension blade 64 contacts the side of the element contact 51 as shown.

Figure 3:
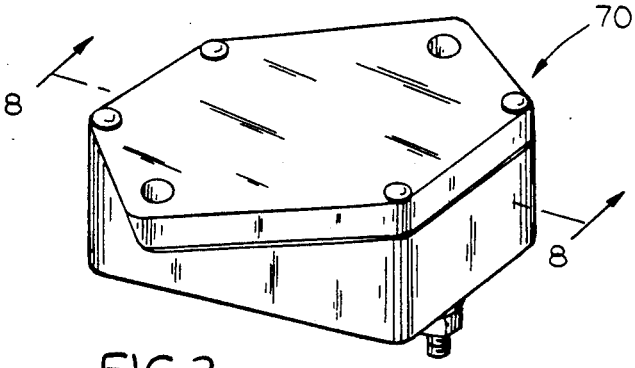
FIG. 3 is a top front right perspective view of an auto-reset panel mount circuit breaker of the present invention.
Figure 4:
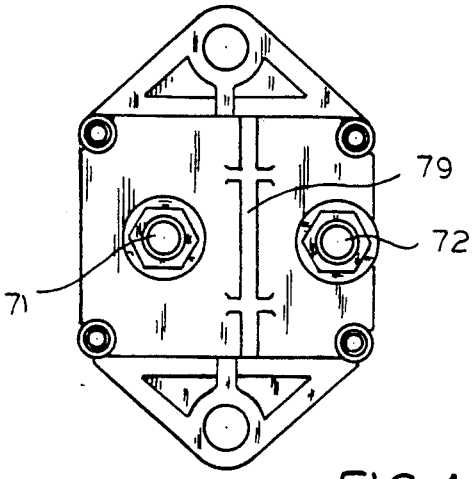
FIG. 4 is a bottom plan view of the circuit breaker of FIG. 3.
Figure 8:
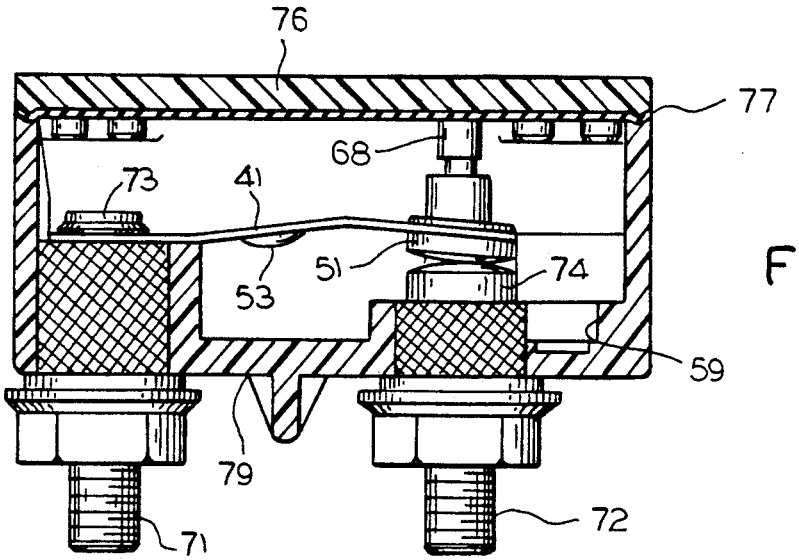
FIG. 8 is a partial sectional view taken along lines 8—8 of FIG. 3.

When referring to FIG. 3, 4, and 8, there is shown an auto reset panel mount circuit breaker 70. The auto-reset panel mount circuit breaker has generally the same internal construction as the manual-reset firewall mount circuit breaker 20 described above. We have shown a panel mount circuit breaker to illustrate a variety of circuit breakers on which our invention can be utilized. In the panel mount circuit breaker, the terminals 71 and 72 extend from below the central housing and would be on the opposite side of a reset lever. This is about the only difference between a firewall and panel mount. The difference between an auto-reset and the manual-reset for either the firewall or panel mount circuit breaker is elimination from the auto reset circuit breaker of the reset lever, the reset lever shaft, and its accompanying mechanisms such as the paddle and spring. However, the central housing cavity of the auto reset circuit breaker is usually the same as used in the manual reset circuit breaker except for the cover which will be a totally flat surface. For the ease of explanation, and brevity, we have not included an auto reset perspective view for a firewall mounted circuit breaker in that the perspective view would be the same except for the flat cover. We are showing a panel mount circuit breaker for the auto reset.

The panel circuit breaker 70 also has the advantageous structure of having both terminals 71 and 72 extending from a single side of the circuit breaker. This allows the terminals to be easily utilized for electrical connections.

The interior of the central housing of the auto reset circuit breaker is identical to the manual-reset housing cavity in that it contains the blind hole 59 and the spring post 68. This is done so that the base of the circuit breakers can be interchangeable for manual and auto-resets.

The auto reset has the same bistable element 41 as was previously described with regard to FIGS. 9–11. The one end 44 of the bistable element is fixedly electrically connected to a first terminal contact 73 by a mechanical stake. The other has the movable contact 51 electrically contacting a second terminal contact 74. The element contact 51 is movable relative to the terminal contact 74. The terminal contact 74 is appropriately electrically connected to the second terminal 72.

When an overload current is encountered, the bistable element end 46 snaps upwardly to a second position so that the element contact 51 separates a predetermined distance from the second terminal contact 74. This condition is maintained until the bistable element has cooled a predetermined amount and the bistable element snaps back to the first position shown in FIG. 8. The bistable element will continue to snap act between the first and second positions at regular intervals so long as the overload condition exists.

Figure 6:
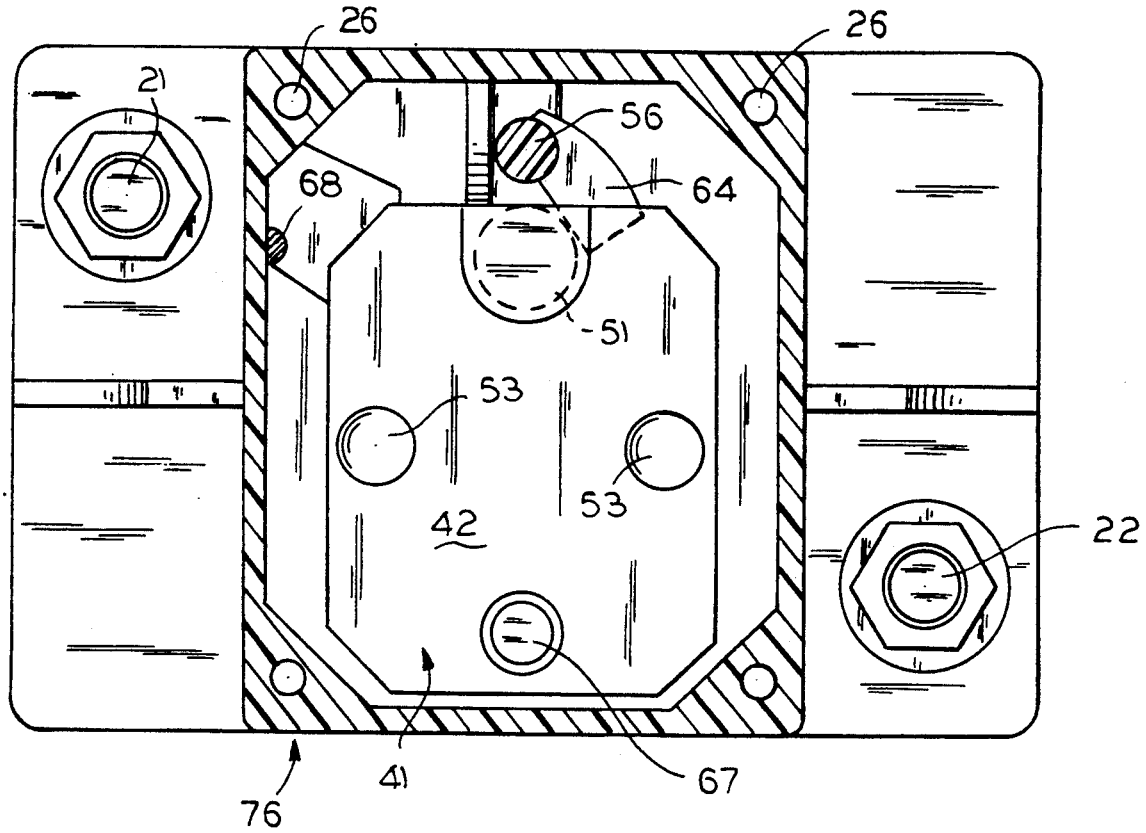
FIG. 6 is a partial top sectional view taken along lines 6—6 of FIG. 5.
Figure 7:
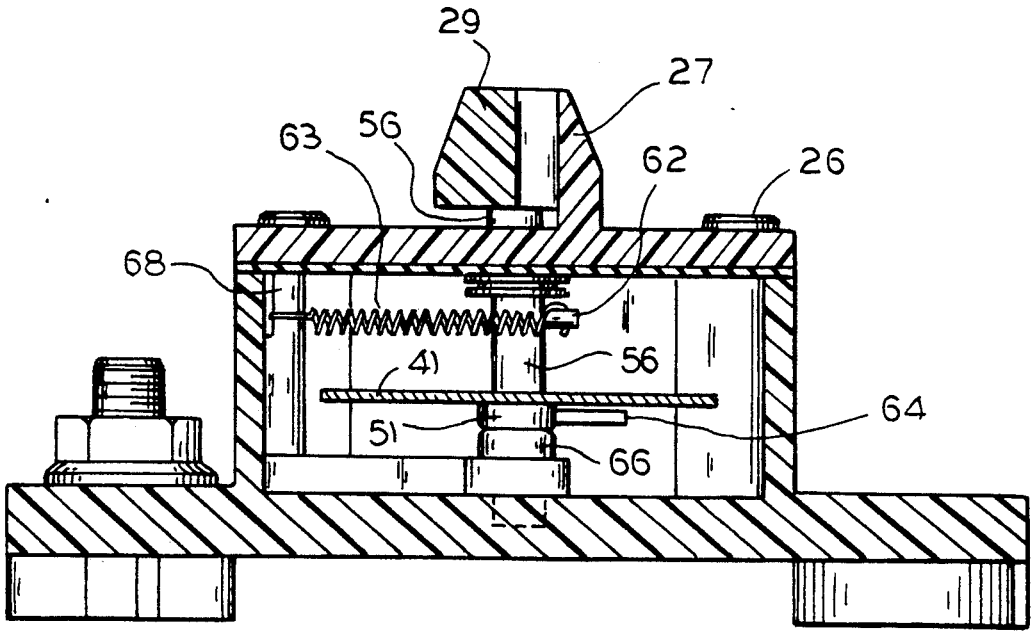
FIG. 7 is a partial sectional view taken along lines 7—7 of FIG. 5.

In the panel mount circuit breaker there is a top cover 76 having a rectangular central portion (not shown) and triangular end portions (not shown). The terminals 71, 72 extend from the bottom of the housing and are separated by a reinforcing partition 79. The housing cover 76 is attached to the central housing by way of rivets 26 (see FIG. 6) and appropriate sealants. Between the cover and the housing is an appropriate seal 77 extending across the entire housing cavity. The first and second terminals 71, 72 extend from the base of the central housing. The breaker 70 has a central cavity with a bottom, end walls and side walls (see FIG. 3).

While particular embodiments of the present invention have been disclosed, it is understood that various different modification are possible and are contemplated within the true spirit and scope of the appended claims. There is no intention, therefore, of limitations to the exact abstract or disclosure herein presented.

We claim:

1. A high amperage circuit breaker comprising a pair of spaced terminals being placed in series with the circuit to be protected;

a heat resistant electrical insulating plastic housing defining a body cavity, said body cavity having a base, a front wall, a rear wall and two side walls, a cover to close said housing;

a rectangular thermally activated bistable mechanical element mounted in said cavity, at least one dimple formed on said bistable element;

a first contact being connected to one of said terminals, said first contact also connected to one end of said bistable element by means wherein the one end of said bistable element always remains stationary with respect to the first contact and in electrical contact with the first contact;

a second electrical contact attached to the other end of said bistable element;

said other end of said bistable element being free to move in a relatively vertical direction;

a third contact electrically connected to said other terminal and being positioned relative to said second contact wherein said second and third contact are normally in electrical contact with each other when the bistable element is in a first position, and said first position being to close the circuit of the circuit breaker;

said bistable element having a predetermined current response to quickly default when there is a predetermined over current, said deflection causing said other end of said bistable element to move from said first position to a second position and to cause said second contact to separate from said third contact by a predetermined distance to open the circuit of the circuit breaker, said circuit breaker being a manual-reset and further comprising a plastic rotatable shaft having one end rotatably mounted in the said cavity base and the other end extending out of said housing for a predetermined distance, said shaft other end extending out of said cover for a predetermined distance;

a pair of longitudinally spaced first and second integral bars extending from said rotatable shaft, said second bar extending a predetermined distance from said first bar and being sized to provide predetermined electrical insulation, said second bar being in contact with the outer surface of said second contact when the electrical circuit is closed;

a spring attached to said first bar and said housing, said spring exerting a rotational force on said plastic shaft to urge the second bar in contact with and toward said second contact;

wherein when said second and third contacts are separated said spring rotates to position said second bar between said second and third contacts and electrically separates said second and third contacts from each other.

2. A high amperage circuit breaker comprising a pair of spaced terminals being placed in series with the circuit to be protected;

a heat resistant electrical insulating plastic housing defining a body cavity, said body cavity having a base, a front wall, a rear wall and two side walls, a cover to close said housing;

a rectangular thermally activated bistable mechanical element mounted in said cavity, at least one dimple formed on said bistable element;

a first contact being connected to one of said terminals, said first contact also connected to one end of said bistable element by means wherein the one end of said bistable element always remains stationary with respect to the first contact and in electrical contact with the first contact;

a second electrical contact attached to the other end of said bistable element;

said other end of said bistable element being free to move in a relatively vertical direction;

a third contact electrically connected to said other terminal and being positioned relative to said second contact wherein said second and third contact are normally in electrical contact with each other when the bistable element is in a first position, and said first position being to close the circuit of the circuit breaker;

said bistable element having a predetermined current response to quickly default when there is a predetermined over current, said deflection causing said other end of said bistable element to move from said first position to a second position and to cause said second contact to separate from said third contact by a predetermined distance to open the circuit of the circuit breaker, said bistable element further comprising at least two dimples formed on the upper face and adjacent opposite sides of said bistable element, and said bistable element having a length greater than a width with said length being greater than ½ the width, said circuit breaker being a manual-reset and further comprising a plastic rotatable shaft having one end rotatably mounted in said cavity base and the other end extending out of said housing for a predetermined distance, said other end of said shaft extending out of said cover for a predetermined distance;

a pair of longitudinally spaced first and second integral bars extending from said rotatable shaft, said second bar extending a predetermined distance from said first bar and being sized to provide predetermined electrical insulation, said second bar being in contact with the outer surface of said second contact when the electrical circuit is closed;

a spring attached to said first bar and said housing, said spring exerting a rotational force on said plastic shaft to urge the second bar in contact with and toward said second contact;

wherein when said second and third contacts are separated said spring rotates to position said second bar between said second and third contacts and electrically separates said second and third contacts from each other.

3. The circuit breaker of claim 1 wherein, a blind hole is defined by said cavity adjacent said rear wall, said rotatable shaft having said one end rotatably mounted in said blind hole said first bar being adjacent the top of said housing, said second bar being paddle shaped;

said dimples on said bistable element having a diameter of 5/16 to ⅜ inch and a central depth of 0.050 to 0.080 inches;

said first contact being connected to said one end of said bistable element by mechanical stake joint;

said second electrical contact attached to and extending from the underside of the other end of said bistable element; and said bistable element having a length and width that is at least 75% of the length and width of said cavity.

4. The circuit breaker of claim 2 wherein the circuit breaker is a manual reset low voltage DC high-amp panel mount circuit breaker wherein both terminals extend from a same side of the circuit breaker opposite said reset lever side.

5. The circuit breaker of claim 3 wherein the circuit breaker is a manual reset low voltage DC high-amp firewall mount circuit breaker wherein both terminals extend from a same side of the circuit breaker on the same side as said reset lever.

6. A high amperage manual reset D.C. circuit breaker comprising a heat resistant electrical insulating plastic housing defining a rectangular central body cavity, with a base, front wall, a rear wall and two side walls;

a blind hole defined by said cavity base adjacent said rear wall;

a pair of spaced terminal bolts extending through said base with a pair of contact nuts being external of said housing, said spaced terminals being placed in series with the circuit to be protected;

an insulating plastic rotatable shaft having one end rotatably mounted in said blind hole and the other end extending out of said housing for a predetermined distance;

a cover to close said housing;

a seal placed between said housing and said cover to seal said cover to said housing;

means to permanently attach said cover to said housing;

said shaft other end extending out of said cover for a predetermined distance;

a seal ring attached to said cover and said shaft;

a pair of longitudinally spaced first and second integral bars extending from said rotatable shaft;

said first bar being adjacent the top of said housing;

a paddle shaped bar extending a predetermined distance from said first bar, said second bar having a relatively straight side, said second bar being sized to provide predetermined electrical insulation;

a generally rectangular thermally activated bistable mechanical element, a pair of dimples formed on an upper surface of and adjacent opposite sides of said bistable element, said dimples having a diameter of approximately 5/16 to ⅜ inch and a central depth of approximately 0.050 to 0.080 inches;

a first contact being connected to one of said terminals, said first contact also connected to end of said bistable element by a washer and a mechanical stake joint wherein the one end of said bistable element always remains stationary with respect to the first contact and in electrical contact with the first contact;

a second electrical contact attached to and extending from the underside of the other end of said second electrical contact;

said other end of said bistable element being free to move in a relatively vertical direction;

a vertical plane passing through a center of said first contact and a center of said second contact being perpendicular to a vertical plane passing through centers of said pair of dimples;

a third contact electrically connected to said other terminal and being positioned below said second contact, said second and third contact normally being in electrical contact with each other to close the circuit of the circuit breaker;

said second bar having its side in contact with the outer surface of said second contact when the electrical circuit is closed;

a spring attached to said first bar and said housing, said spring exerting a rotational force on said plastic shaft to urge the second bar in contact with said second contact and toward said second contact;

said bistable element having a predetermined current response to quickly deform when there is a predetermined over current, said deformation causes said other end to vertically rise and to cause said second contact to separate from said third contact by a predetermined distance; and wherein said second and third contacts are separated said spring rotates to position said second bar between said second and third contacts and electrically separate said second and third contacts from each other.

* * * * *